US006059477A

United States Patent [19]

Dunlap, Jr. et al.

[11] Patent Number: 6,059,477

[45] Date of Patent: May 9, 2000

[54] NIB FOR A MARKING PEN AND METHOD OF FORMING THE SAME

[75] Inventors: Earl S. Dunlap, Jr., Riverside, R.I.; Stephen L. Ford, Middleboro, Mass.

[73] Assignee: Bacon Felt Company, Inc., Taunton, Mass.

[21] Appl. No.: 09/257,337

[22] Filed: Feb. 25, 1999

Related U.S. Application Data

[60] Provisional application No. 60/076,256, Feb. 27, 1998.

[51] Int. Cl.[7] ..... B43K 5/00

[52] U.S. Cl. ..... 401/199; 401/198; 29/453; 29/557; 29/558

[58] Field of Search ..... 401/198, 199; 29/557, 558, 453

[56] References Cited

U.S. PATENT DOCUMENTS 3,639,070 2/1972 Davidson ..... 401/199

FOREIGN PATENT DOCUMENTS 2319942 10/1974 Germany ..... 401/198

1086310 10/1967 United Kingdom ..... 401/198

*Primary Examiner*—Henry J. Recla
*Assistant Examiner*—Khoa Huynh
*Attorney, Agent, or Firm*—Lorusso & Loud

[57] ABSTRACT

A nib for a marking pen which has at least one, preferably two, grooves or valleys formed in the sides thereof which intersect a projection on an inside surface of the marking pen barrel for securing the nib within the marking pen. In the preferred embodiment, the nib is formed from flat strips of stock by forming two grooves down the center of the strip and subsequently cutting parallelogram-shaped nibs from the strip. When the nib is assembled to the pen, the projection intersects a first one of the grooves at a front of the nib, and intersects the second one of the grooves at the back of the nib. Advantageously, this construction provides for stable orientation of the nib within the pen and facile assembly, without the need for pinning or die cutting an irregular shape. In addition, the method of forming the nib allows for high throughput production.

12 Claims, 4 Drawing Sheets

NIB FOR A MARKING PEN AND METHOD OF FORMING THE SAME

CROSS-REFERENCE TO RELATED APPLICATIONS

The present application claims priority to U.S. Provisional Application Ser. No. 60/076,256 filed Feb. 27, 1998, the teachings of which are incorporated herein by reference.

FIELD OF THE INVENTION

The present invention relates in general to marking pens, and in particular to a tip or nib for a marking pen having grooves therein for stabilizing the nib within the marking pen, and a method of forming the nib.

BACKGROUND OF THE INVENTION

In the process of manufacturing marking pens, such as MAGIC MARKERS, a marker tip or nib is typically inserted into a top portion of a separate marking pen body which includes an ink reservoir. Ink is stored in the reservoir, and, when the pen is inverted, i.e., with the nib against the writing surface, the ink is absorbed by the nib and transferred through the nib to the writing surface. In view of the physical forces imparted on the nib during use, it is important the nib be assembled to the pen in a manner which prevents facile over-insertion of the nib into the reservoir and facile removal of the nib from the reservoir.

Traditionally, the nib has been stabilized within the pen by a pinning operation, or by forming the nib in an irregular shape. Forming the nib in an irregular shape, i.e., non-parallelogram, requires an expensive die cutting operation. Pinning the nib during the assembly process involves insertion of a common stainless steel pin in the barrel of the pen at or near its end and through the nib which is inserted therein. This process permits manufacture of the nibs in a shape, commonly a parallelogram shape, which is economical for the nib manufacturer to produce. Pinning, however, is troublesome from a mechanical standpoint since it limits assembly throughput speed and involves use of complex, high-maintenance machinery. Also, the pinning process inherently involves a risk that the pin will not properly penetrate the pen nib thereby leaving the nib in an unsatisfactorily secured condition. When the pin does pass through the nib properly, there is a localized restrictive effect on the nib in the area of the pin whereby the flow of ink through the nib is impeded.

There is, therefore, a long-felt need in the art for a nib for a marking pen which is cost-efficient to produce, and which allows for facile assembly of the nib to the marking pen and stable orientation of the nib within the pen.

OBJECTS OF THE INVENTION

Accordingly, a primary object of the present invention is to provide a nib for a marking pen which is cost-efficient to produce, and which allows for facile assembly of the nib to the marking pen and stable orientation of the nib within the pen.

Another object of the present invention is to provide a nib having a parallelogram shape and which may be securely positioned within an end of the marking pen barrel.

Yet another object of the present invention is to provide a nib for a marking pen having at least one groove or valley formed through the sides thereof which are adapted to intersect an annular projection on the inside of the marking pen barrel.

A further object of the present invention is to provide a cost-efficient method of manufacturing a nib for a marking pen from flat sheets of stock.

Still another object of the present invention is to provide a marking pen having an annular projection on the inside of the pen barrel which intersects a groove or grooves formed in a nib of the marking pen.

Still a further object is of the present invention is to reduce the manufacturing cost for marking pens and nibs therefor.

These and other objects of the present invention will become apparent from a review of the description provided below.

SUMMARY OF THE INVENTION

The present invention is organized about the concept of providing a marking pen having a nib with at least one, preferably two, grooves or valleys formed in the sides thereof which intersect an annular projection on an inside surface of the marking pen barrel for securing the nib within the marking pen. In the preferred embodiment, the nib is formed from a flat strip of stock by forming two grooves down each side of the strip and subsequently cutting parallelogram-shaped nibs from the strips. When the nib is assembled to the pen, the annular projection intersects the top grooves on each side of the nib at a front of the nib, and intersects the bottom grooves at the back of the nib. Advantageously, this construction provides for stable orientation of the nib within the pen and facile assembly, without the need for pinning or die cutting an irregular shape. In addition, the method of forming the nib allows for high throughput production of nibs.

Specifically, the marking pen of the present invention includes a body having an interior surface and portions defining an opening in an end thereof, and a nib having a top for contacting a writing surface and a bottom disposed within the opening in the body of the pen. The body includes a projection on its interior surface which extends into at least one groove formed in a surface of the nib to thereby resist removal of the nib from the body and resist depression of the nib into the body.

In a preferred embodiment, the nib is cut into a parallelogram shape, and includes a first top groove and a first bottom groove formed in a first side thereof, and a second top groove and a second bottom groove formed in a second side thereof. The projection is preferably annular in shape, and extends into the first and second top grooves adjacent a fourth side of the nib and into the first and second bottom grooves adjacent a third side of the nib. The projection has a beveled top surface, and a bottom surface which is substantially perpendicular to the interior surface of the pen. Although not absolutely necessary, the beveled top surface of the projection and optional chamfered edges on the bottom of the nib facilitate insertion of the nib into the body of the pen. As the nib is forced axially into the body, the chamfered bottom edges of the nib engage and slip past the beveled top edge of the projection to allow the nib to travel into the body until the projection intersects and extends into the grooves in the nib, thereby securing the nib within the body.

A method according to the invention of making a nib for a marking pen includes: providing a flat strip of stock; forming at least one strip groove in the flat strip; and cutting the nib from the strip such that at least a portion of the strip groove defines the groove in the nib. The groove in the nib is dimensioned to receive the projection formed on the inside surface of the marking pen to thereby resist removal of the nib from the marking pen and resist depression of the nib into the marking pen. Preferably, a first top strip groove and a first bottom strip groove are formed in a first side of the flat strip, and a second top strip groove and a second bottom strip groove are formed in a second side of the strip. A parallelogram-shaped nib is cut from the strip such that a portion of the first and second top strip grooves define first and second top grooves in the nib positioned for receiving the projection, and such that a portion of the first and second bottom strip grooves define first and second bottom grooves in the nib positioned for receiving the projection.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION OF THE INVENTION

Figure 1:
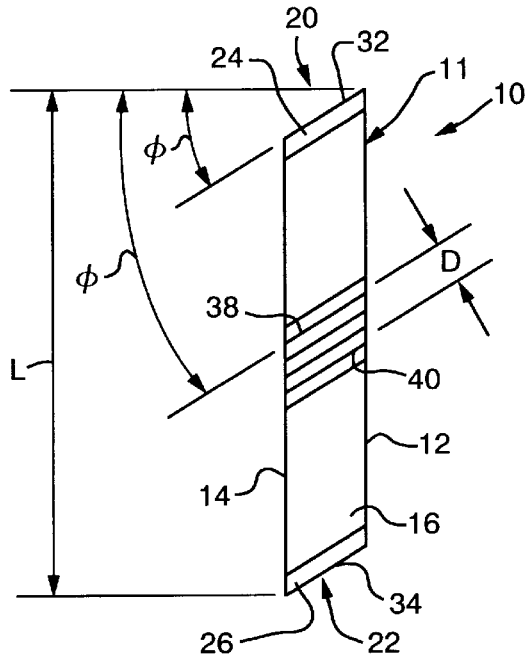
FIG. 1: is a side view of a preferred marking pen nib according to the invention.
Figure 2:
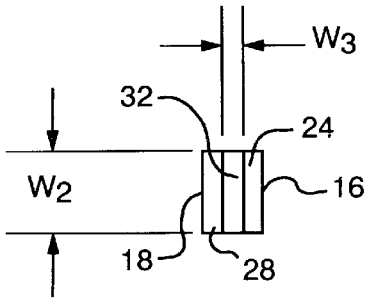
FIG. 2: is a top view of the marking pen nib of FIG. 1.
Figure 3:
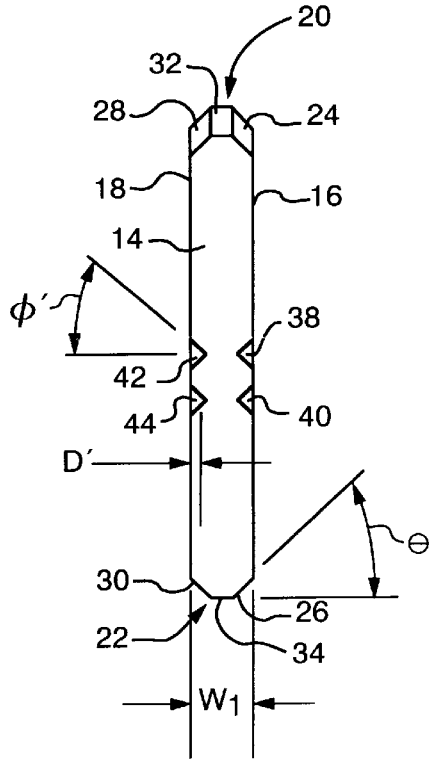
FIG. 3: is an isometric end view of the nib of FIG. 1.

Referring now to FIGS. 1–3, a preferred embodiment of a marking pen nib 10 according to the invention has a parallelogram-shaped body 11 having a top 20 and a bottom 22, a first side surface 16 which is parallel with a second side surface 18, and a third side surface 12 which parallel with a fourth side surface 14. In a manner which will be described in more detail below, the body is preferably formed from a flat strip of stock made by felting of wool or other natural fibers. It is well known to those skilled in the art, however, that the strip may also be formed from needled synthetic fibers which have been resinated with crosslinking and/or non-crosslinking polymers to hold the fibers firmly locked to one another, or from a combination of needled synthetic fibers and natural fibers.

The top 20 of the nib is preferably formed with first 24 second 28 chamfered edges and a flat top 32 surface, and the bottom 22 is formed with first 26 and second 30 chamfered edges and a flat bottom surface 34. The chamfered edges 24,28 at the top of the nib allow for a smooth writing feel. As will be apparent from the description provided below, the chamfered edges 26,30 on the bottom 22 of the nib facilitate assembly of the nib to the pen body.

In one exemplary embodiment, where the nib has thickness W1 of about 0.145" width W2 of about 0.185", and length L of about 1.150", the chamfered edges are formed at an angle θ of about 45 degrees to leave a flat top/bottom portion having a width W3 of about 0.048". Obviously, however, the dimensions of the nib will change with pen size, desired performance characteristics, cost considerations, etc. Also, those skilled in the art will recognize that it is possible to provide the top and/or bottom of the nib with a different shape.

Advantageously, the nib is also provided with grooves 38, 40, 42, 44 formed in the first 16 and second 18 side surfaces thereof which extend in the surfaces to intersect the third 12 and fourth 14 side surfaces. As will be discussed in detail below, the grooves are dimensioned to receive a projection (e.g., 46 in FIG. 5) on the interior of the pen body for thereby securing and stabilizing the nib within the pen. Those skilled in the art will, therefore, recognize that the dimension and positioning of the grooves may be varied depending on the particular pen body. In an exemplary embodiment, however, the grooves are formed in a triangular shape at an angle ϕ of about 45 degrees to be substantially parallel to the top and bottom flat surfaces 32, 34. The grooves are formed to a depth D' of about 0.030", and the sides of each triangular groove are at an angle ϕ' of about 45 degrees. Also, the centers of the grooves are spaced by a distance D of approximately 0.106".

Engagement of the annular projection 46 on the interior of the pen body with the grooves allows for the nib to be secured in the pen without the need for forming the nib in a non-uniform shape. Accordingly, the economical parallelogram-shaped nib as shown in FIG. 1, may be utilized while eliminating the possibility of facile over-insertion or removal of the nib from the body. It is to be understood, however, that although the nib is formed in parallelogram shape in the preferred embodiment, it would be equally possible to form the nib in an irregular shape with the grooves. Forming the nib in an irregular shape with the grooves would be more costly, but one or more groove(s) intersecting a projection on the pen body would still provide secure positioning of the nib within the pen.

Figure 4:
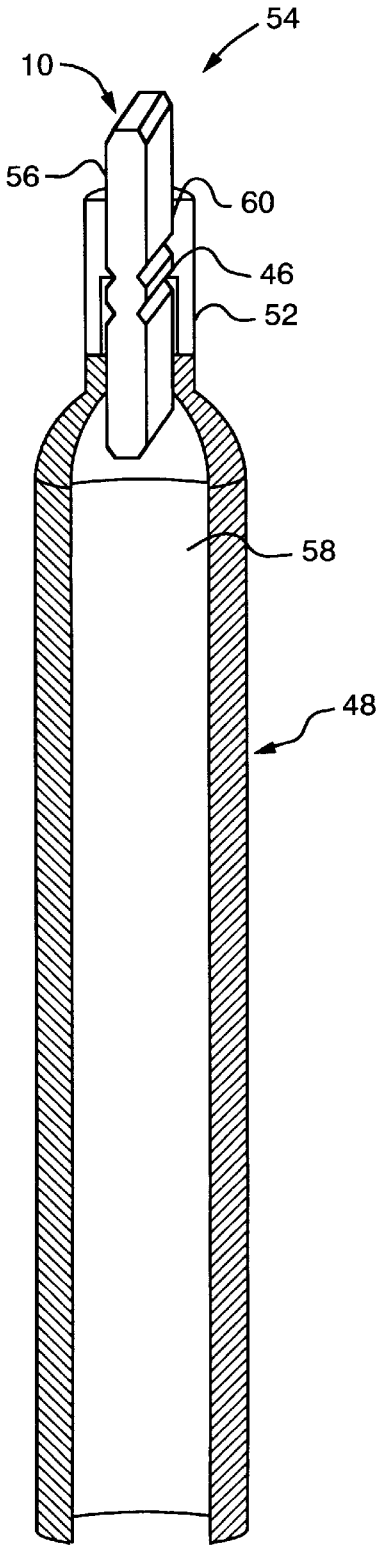
FIG. 4: is an isometric cut-away view of a marking pen according to the invention showing a nib according to the invention secured therein.
Figure 5:
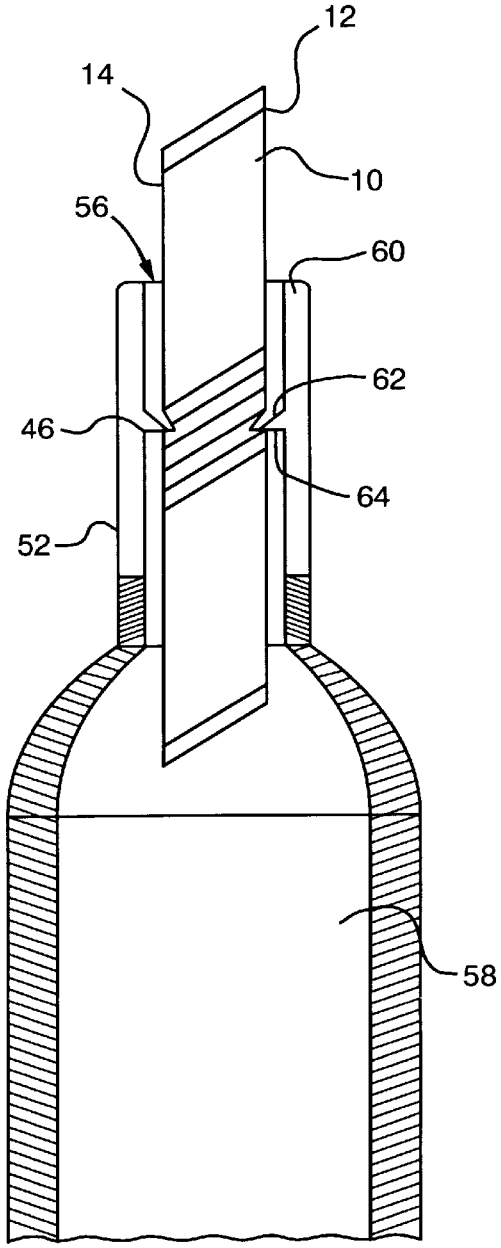
FIG. 5: is a side cut-away view showing a detailed view of the barrel end of the marking pen shown in FIG. 4.

Turning now to FIGS. 4–5, the nib of the present invention is shown assembled to a pen body 48 to form a pen 54 according to the invention. Although, those skilled in the art will recognize that the body and barrel portion can be formed in non-cylindrical shapes with corresponding changes in the nib shape, in the illustrated embodiment, the pen body is cylindrical and includes a cylindrical end barrel portion 52. The barrel 52 defines an opening 56 into the interior 58 of the body which serves as a ink reservoir. The opening 56 in the barrel 52 receives the nib 10 therein so that ink (not shown) may be passed from the reservoir 58 through the nib 10 and onto the writing surface during use.

Advantageously, the interior surface 60 of the barrel portion includes a projection 46 thereon for engaging the grooves 38, 40, 42, 44 in the nib. Although the projection could take a variety of shapes, the projection 46 on the interior surface of the cylindrical barrel 52 is annular and has a beveled top edge 62 to allow for facile insertion of the nib into the opening. The bottom edge 64 of the projection in the illustrated embodiment is perpendicular to the interior surface 60 of the barrel to maximally resist removal of the nib from the opening. During assembly, the nib is forced downward against the projection 46 with an axial force which would greatly exceed an ordinary axial force imposed upon the nib during use. The engagement of the chamfered edges on the bottom of the nib 26,30 and the beveled top edge 62 of the annular projection, and the compressible nature of the material from which the nib is made, allow the bottom of the nib to be forced axially past the annular projection in the direction of the ink reservoir.

Figure 6:
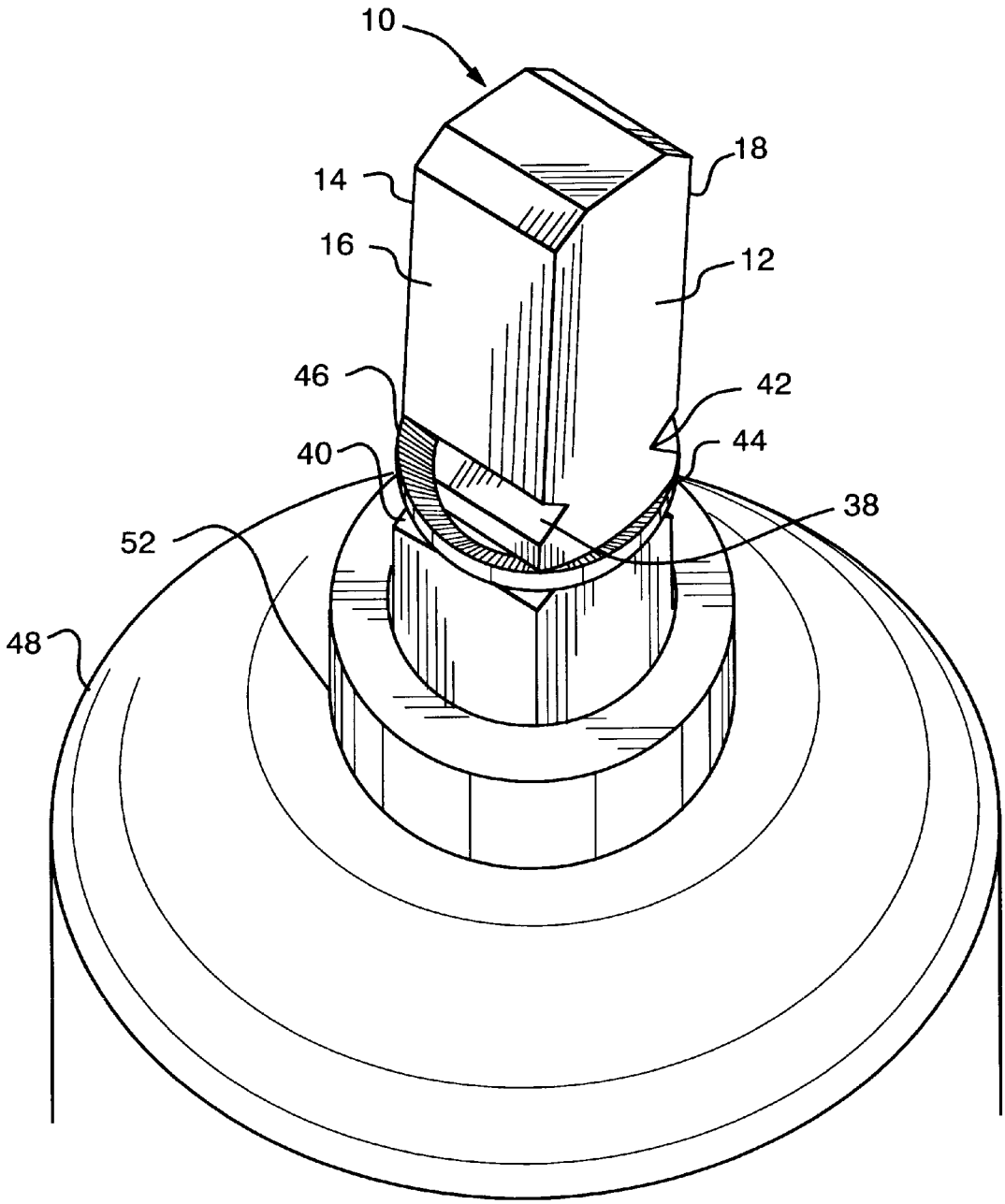
FIG. 6: is an isometric cut-away view of a marking pen and nib according to the invention wherein a portion of the barrel has been cut away to show engagement of the annular projection with the grooves in the nib.

The nib is forced into the opening until the annular projection 46 engages the grooves formed in the sides of the nib. As shown particularly in FIGS. 5 and 6, since the grooves are formed in the sides of the nib at an angle ϕ (FIG. 1), when the nib is assembled to pen body, the annular projection 46 of the pen body engages the top grooves 38,42 adjacent the fourth side surface 14 and engages the bottom grooves 40,44 adjacent the third side surface 12 of the nib. Thus, in the preferred embodiment the annular projection engages the top and bottom grooves on each side 16,18 to properly secure the nib within the pen body. It is to be understood, however, that although the preferred embodiment includes two continuous nib grooves on each side, it would be possible to include only a single groove on each side disposed at an angle which would engage the projection at both ends of the nib, or to provide the one or more grooves in the ends of the nib. Also, it would be possible to provide a discontinuous projection or numerous annular projections which engage numerous grooves in the nib.

In the method of forming a nib according to the invention, the nibs are cut from strips of material derived from sheets of needled felt. Those skilled in the art will recognize that there are a variety of ways to form the nibs. In an exemplary method, however, rolls of polyester needle felt are converted into sheets of material. The sheets are resin-treated to provide the properties required by the particular application, e.g., flow and stiffness, and are dried in still ambient air. The sheets are then heat pressed to cure the resin and to provide a chosen uniform thickness.

Figure 8:
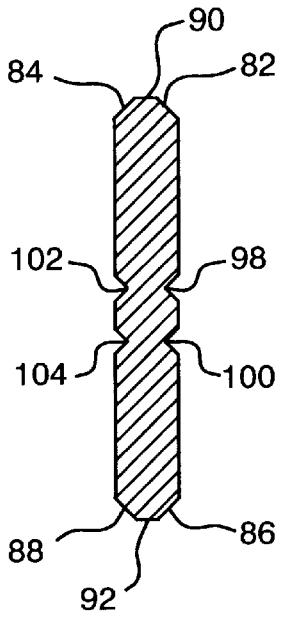
FIG. 8: is a sectional view of the strip of stock shown in FIG. 7 taken along lines 8—8.
Figure 7:
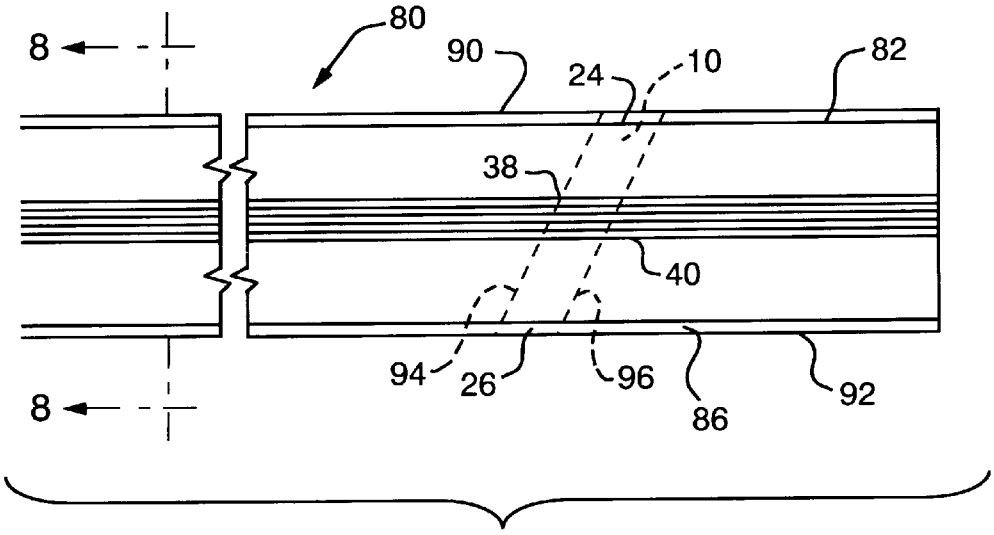
FIG. 7: is a side view of a flat strip of stock having grooves formed therein from which a marking pen nib according to the invention may be produced.

Turning now to FIGS. 7 and 8, flat strips 80 are cut from the sheet and chamfered edges 82, 84, 86, 88 are formed by grinding. Top 98,102 and bottom 100,104 strip grooves having the intended dimensions of the nib grooves 38, 40, 42, 44 for the nibs are then formed along the length of the strip by grinding with formed grinding wheels. The strip grooves 98, 100, 102, 104 are formed to be substantially parallel to the top and bottom flat edges 90,92 and substantially at the midpoint between the top and bottom flat edges. The strip grooves form the nib grooves 38, 40, 42, 44 in each nib and, as discussed above, and are dimensioned to engage the projection on the inside surface of the pen body end.

Subsequently, the strip 80 is cut in successive fashion at spaced locations to form a plurality of parallelogram-shaped nibs having their tops, bottoms, and grooves at an angle ϕ (FIG. 1). One such nib 10, for example, would be formed by cuts at dashed lines 94,96. The individual nibs are then surfactant treated and dried.

There is thus provided a nib for a marking pen which has at least one, preferably two, grooves or valleys formed in the sides thereof which intersect an annular projection on an inside surface of the marking pen barrel for securing the nib within the marking pen. In the preferred embodiment, the nib is formed from flat strips of stock by forming two grooves down the center of the strip and subsequently cutting parallelogram-shaped nibs from the strip. When the nib is assembled to the pen, the annular projection intersects a first one of the grooves at a front of the nib, and intersects the second one of the grooves at the back of the nib. Advantageously, this construction provides for stable orientation of the nib within the pen and facile assembly, without the need for pinning or die cutting an irregular shape. In addition, the method of forming the nib and method of manufacturing a marking pen having such a nib allows for high throughput production of marking pens and nibs therefor.

The embodiments which have been described herein, however, are but some of the several which utilize this invention and are set forth here by way of illustration but not of limitation. It is obvious that many other embodiments, which will be readily apparent to those skilled in the art, may be made without departing materially from the spirit and scope of this invention.

What is claimed is:

1. A marking pen comprising:

a body having an interior surface and portions defining an opening in an end thereof, and a nib having a top for contacting a writing surface and a bottom disposed within said opening, wherein said nib includes parallel first top and bottom grooves formed transversely in a first side surface of said nib, and parallel second top and bottom grooves formed transversely in a second side surface of said nib, wherein said body includes a projection on said interior surface which extends into at least one of said grooves formed in said nib to thereby resist removal of said nib from said body and resist depression of said nib into said body, wherein said projection extends into said first and second top grooves adjacent a fourth side surface of said nib and into said first and second bottom grooves adjacent a third side surface of said nib.

2. A marking pen according to claim 1, wherein said bottom of said nib has first and second chamfered edges.

3. A marking pen according to claim 1, wherein said nib is parallelogram-shaped.

4. A marking pen according to claim 1, wherein said end of said body is cylindrical and wherein said projection is an annular projection.

5. A marking pen according to claim 1, wherein said projection has a beveled top surface.

6. A marking pen according to claim 5, wherein said projection has a bottom surface which is substantially perpendicular to said interior surface.

7. A nib for a marking pen comprising:

a body having a top and a bottom, said bottom being dimensioned to be received within an opening formed in said marking pen; and at least one groove formed in said body, said at least one groove being dimensioned to receive a projection formed on an inside surface of said marking pen to thereby resist removal of said nib from said marking pen and resist depression of said nib into said marking pen, wherein said body includes parallel first top and bottom grooves formed transversely in a first side surface thereof, and parallel second top and bottom grooves formed transversely in a second side surface thereof, said first and second top grooves being positioned in said body for receiving said projection adjacent a fourth surface of said body, and said first and second bottom grooves being positioned in said body for receiving said projection adjacent a third side surface of said body.

8. A nib according to claim 7, wherein said bottom of said body has first and second chamfered edges.

9. A nib according to claim 7, wherein said body is parallelogram-shaped.

10. A method of making a nib for a marking pen comprising:

providing a flat strip of stock;

forming at least one strip groove in said flat strip, wherein said step of forming at least one strip groove comprises forming parallel first top and bottom strip grooves in a first side surface of said flat strip, and forming parallel second top and bottom strip grooves in a second side surface of said flat strip; and cutting said nib from said strip such that at least a portion of said strip groove defines a groove in said nib, wherein said cutting step comprises cutting said nib from said strip such that a portion of said first and second top strip grooves define first and second top grooves in said nib positioned and a portion of said first and second bottom strip grooves define first and second bottom grooves in said nib, said first and second top grooves and said first and second bottom grooves being positioned for receiving said projection, wherein said groove in said nib is dimensioned to receive a projection formed on an inside surface of said marking pen to thereby resist removal of said nib from said marking pen and resist depression of said nib into said marking pen.

11. A method according to claim 10, said method further comprising the step of forming first and second chamfered edges on a bottom of said strip of stock.

12. A method according to claim 10, wherein said nib is parallelogram-shaped.

* * * * *